US012055150B2

(12) United States Patent
Yamazaki

(10) Patent No.: US 12,055,150 B2
(45) Date of Patent: Aug. 6, 2024

(54) REVERSIBLE FAN

(71) Applicant: SANYO DENKI CO., LTD., Tokyo (JP)

(72) Inventor: Yoshihisa Yamazaki, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 0 days.

(21) Appl. No.: 17/731,966

(22) Filed: Apr. 28, 2022

(65) Prior Publication Data

US 2022/0364570 A1 Nov. 17, 2022

(30) Foreign Application Priority Data

May 12, 2021 (JP) ..... 2021-081097

(51) Int. Cl.

| | |
|---|---|
| ***F04D 25/08*** | (2006.01) |
| ***F04D 25/06*** | (2006.01) |
| ***F04D 29/52*** | (2006.01) |
| *F04D 19/00* | (2006.01) |
| *F04D 29/54* | (2006.01) |

(52) U.S. Cl.
CPC ..... *F04D 25/06* (2013.01); *F04D 29/522* (2013.01); *F04D 19/005* (2013.01); *F04D 25/08* (2013.01); *F04D 29/541* (2013.01)

(58) Field of Classification Search
CPC ..... F04D 29/66; F04D 29/661; F04D 29/663; F04D 29/668; F04D 29/44; F04D 29/441; F04D 29/703; F04D 29/681; F04D 29/685; F04D 29/667; F04D 29/522; F04D 29/526; F04D 29/541; F04D 29/542; F04D 29/544; F04D 19/002–007; F04D 25/06; F04D 25/08; F05B 2240/14; F05B 2240/125–127
See application file for complete search history.

(56) References Cited

U.S. PATENT DOCUMENTS 4,930,460 A * 6/1990 Aihara ..... F01P 7/08 123/41.31
6,406,258 B1 * 6/2002 Lin ..... F04D 29/547 415/214.1
7,481,615 B2 1/2009 Park
(Continued)

FOREIGN PATENT DOCUMENTS

DE 2607159 A1 8/1977
JP 6802022 B2 12/2020

OTHER PUBLICATIONS

Extended European Search Report (EESR) dated Oct. 4, 2022 for European Patent Application No. 22169823.6.

*Primary Examiner* — Thomas Fink
(74) *Attorney, Agent, or Firm* — RANKIN, HILL & CLARK LLP

(57) ABSTRACT

Provided is a reversible fan including: a fin configured to produce a current of air in both of a normal direction and a reverse direction; an impeller configured to be rotatable about a rotation axis; a motor configured to rotate the impeller; and a tubular frame housing the impeller and the motor, wherein the fin has a shape that allows producing louder noise upon producing the current of air in the normal direction than upon producing the current of air in the reverse direction, and protrudes inward in a radial direction from an inner peripheral surface of the frame.

4 Claims, 9 Drawing Sheets

(56) References Cited

U.S. PATENT DOCUMENTS

| | | | | |
|---|---|---|---|---|
| 8,221,074 | B2 * | 7/2012 | Nelson | F04D 29/646 415/214.1 |
| 10,844,770 | B2 * | 11/2020 | Hong | F01P 11/10 |
| 2012/0213650 | A1 | 8/2012 | Lee et al. | |
| 2014/0056742 | A1 | 2/2014 | Nakamura et al. | |
| 2015/0132121 | A1 | 5/2015 | Yuan | |
| 2016/0305448 | A1 * | 10/2016 | Hong | F01P 5/06 |
| 2018/0087440 | A1 | 3/2018 | Yamazaki et al. | |

* cited by examiner

REVERSIBLE FAN

CROSS-REFERENCE TO RELATED APPLICATION

This application is based on Japanese Patent Application No. 2021-081097 filed with the Japan Patent Office on May 12, 2021, the entire content of which is hereby incorporated by reference.

BACKGROUND

1. Technical Field

The present disclosure relates to a reversible fan.

2. Related Art

A reversible fan that produces a current of air in the normal direction and the reverse direction is known from, for example, Japanese Patent No. 6802022.

SUMMARY

A reversible fan according to an embodiment of the present disclosure includes: a fin configured to produce a current of air in both of a normal direction and a reverse direction; an impeller configured to be rotatable about a rotation axis; a motor configured to rotate the impeller; and a tubular frame housing the impeller and the motor. The fin has a shape that allows producing louder noise upon producing the current of air in the normal direction than upon producing the current of air in the reverse direction, and protrudes inward in a radial direction from an inner peripheral surface of the frame.

DETAILED DESCRIPTION

Figure 1:
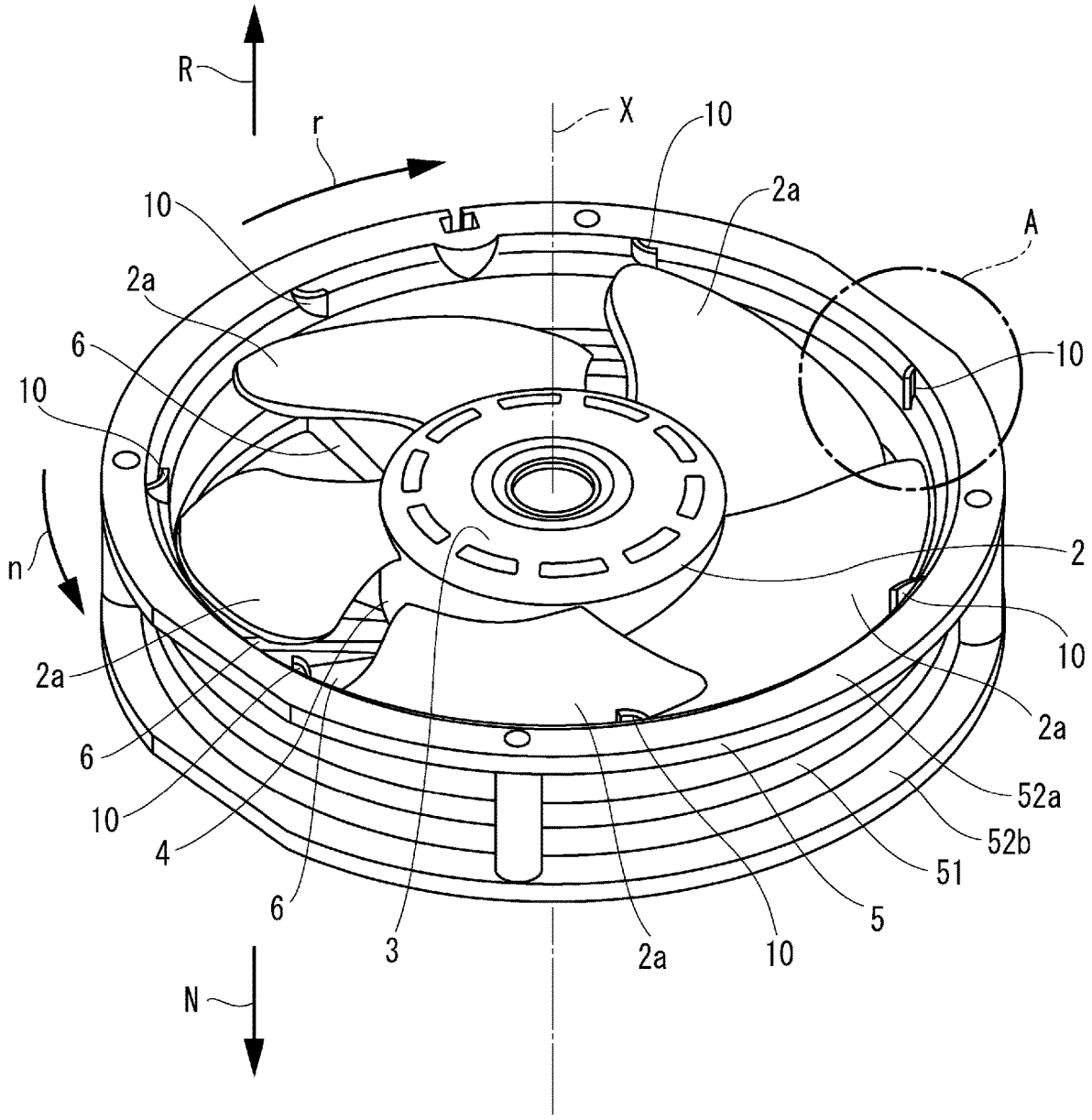
FIG. 1 is a perspective view of a reversible fan according to an embodiment of the present disclosure as viewed from the reverse direction.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Such a reversible fan is attached to, for example, the wall of a house. In some cases, the reversible fan is used to draw outside air into the room and increase the room temperature when the outside air is warmer, or discharge the air in the room to the outside and decrease the temperature when the room temperature is high. At this point in time, if the noise generated when the outside air is drawn in is different from the noise generated when the air in the room is discharged, the resident may suspect that the fan is faulty.

If equal noise characteristics are required upon blowing air in the normal and reverse directions in this manner, the idea of lowering the noise level at times of blowing air in the reverse direction to adjust to the noise level at times of blowing air in the normal direction, which is lower, is generally adopted.

However, in the embodiment, in contrast to such an idea, it has been realized that there is no problem in making the noise levels equal by increasing the noise level at times of blowing air in the normal direction, depending on the use. For example, in the above-mentioned use, the noise levels at times of blowing air in the normal and reverse directions are not equal; therefore, the apparatus is suspected to be faulty. Hence, even if the noise levels at times of blowing air in the normal and reverse directions are regularly high, as long as the noise levels are equal, the apparatus is not suspected to be faulty.

Hence, an object of the present disclosure is to provide a reversible fan that can make the noise level at times of blowing air in the normal direction equal to the noise level at times of blowing air in the reverse direction by increasing the noise level at times of blowing air in the normal direction.

A reversible fan according to one aspect of the present embodiment includes: a fin configured to produce a current of air in both of a normal direction and a reverse direction; an impeller configured to be rotatable about a rotation axis; a motor configured to rotate the impeller; and a tubular frame housing the impeller and the motor. The fin has a shape that allows producing louder noise upon producing the current of air in the normal direction than upon producing the current of air in the reverse direction, and protrudes inward in a radial direction from an inner peripheral surface of the frame.

According to the embodiment, it is possible to provide a reversible fan that can make the noise level at times of blowing air in the normal direction equal to the noise level at times of blowing air in the reverse direction by increasing the noise level at times of blowing air in the normal direction.

The embodiment of the present disclosure is described hereinafter with reference to the drawings. Descriptions of members having the same reference numerals as members that have already been described in the detailed description are omitted for the sake of convenience. Moreover, the dimensions of each member illustrated in the drawings may be different from actual dimensions thereof for the convenience of description.

FIG. 1 is a perspective view of a reversible fan 1 according to the embodiment. As illustrated in FIG. 1, the reversible fan 1 includes an impeller 2 that can rotate about a rotation axis X, a motor 3 that rotates the impeller 2, a base portion 4 that supports the motor 3, and a tubular frame 5 where these members are housed. The impeller 2, the motor 3, and the base portion 4 are housed in the frame 5 in such a manner as to overlap along a direction of the rotation axis X.

In the embodiment, a direction (an arrow N direction) where air (a current of air) is discharged when the impeller 2 of the reversible fan 1 illustrated in FIG. 1 rotates in an arrow n direction (a normal rotation direction) is referred to as the normal direction of the reversible fan 1. Moreover, a direction (an arrow R direction) where air (a current of air) is discharged when the impeller 2 rotates in an arrow r direction (a reverse rotation direction) is referred to as the reverse direction of the reversible fan 1.

The reversible fan 1 is a fan that can blow air (produce a current of air) in both of the normal and reverse directions.

The impeller 2 is formed in a substantially cup shape. A plurality of (five in the example illustrated in the drawing) blades 2*a* is radially attached to the perimeter of the impeller 2. The blades 2*a* are attached to the impeller 2 in such a manner that surfaces of the blades 2*a* are inclined with respect to an axial direction (the same direction as the rotation axis X) of a rotating shaft portion of the reversible fan 1. With the rotation of the blades 2*a*, the impeller 2 produces a current of air in the normal or reverse direction.

The motor 3 is provided in the impeller 2. The motor 3 is configured as, for example, an outer rotor brushless motor. The motor 3 includes a stator, and a rotor that is placed outward of the stator. The rotor portion of the motor 3 in the impeller 2 is fixed to the impeller 2. The motor 3 is assembled in the impeller 2 in such a manner as to be placed on the front side (the normal direction side) relative to the impeller 2.

The base portion 4 is formed in the form of, for example, a circular cup. The base portion 4 is provided in such a manner as to cover the front side of the motor 3. The base portion 4 supports the stator portion of the motor 3. The base portion 4 is assembled in the frame 5 in such a manner as to be placed on the front side relative to the motor 3.

The base portion 4 is supported by a plurality of spokes 6. Each of the spokes 6 extends radially in the radial direction from a peripheral portion of the base portion 4 and is connected to an inner peripheral surface of the frame 5. The base portion 4 supported by the spokes 6 is attached at a position close to the front side of the tubular frame 5 extending along the rotation axis X.

The frame 5 includes a main body portion 51 forming the tubular part, and flange portions 52*a* and 52*b* provided respectively on outer regions of opposite ends of the main body portion 51. The frame 5 is provided with a plurality of fins 10 protruding inward in the radial direction from the inner peripheral surface of the frame 5. If the number of the blades 2*a* is five as in this example, the number of the fins 10 is desirably, for example, 7 to 9, or 11 to 14. However, the number of the fins 10 that is n times the number of the blades (10 (n=2) in the example illustrated in the drawing) is excluded since acoustic resonance tends to occur.

Next, the fin 10 provided to the frame 5 is described with reference to FIGS. 2 and 3.

Figure 2:
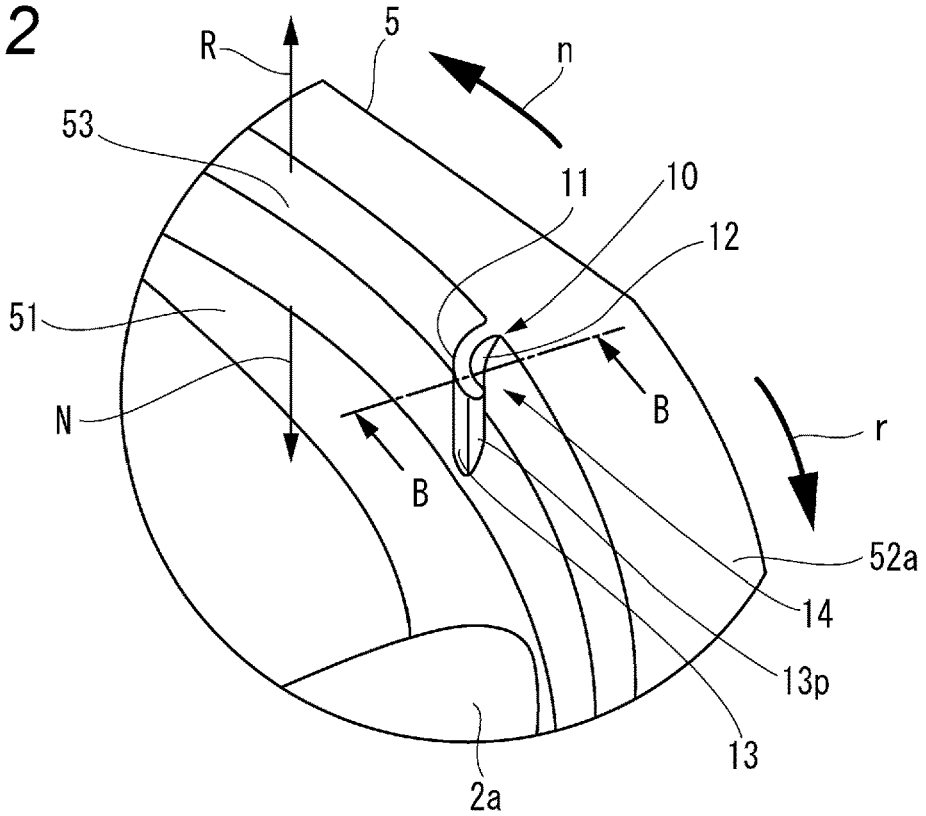
FIG. 2 is a partial enlarged view illustrating a fin provided in an area A in FIG. 1.

FIG. 2 is a partial enlarged view illustrating the fin 10 provided in an area A in FIG. 1. FIG. 3 is a cross-sectional view taken along line B-B in FIG. 2.

Figure 3:
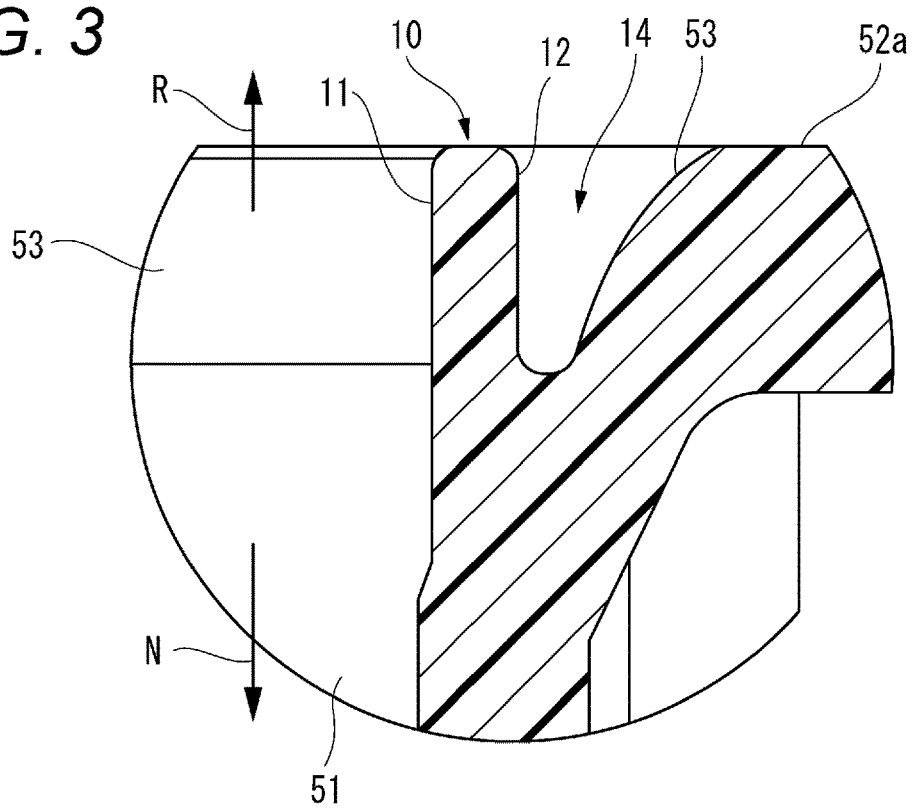
FIG. 3 is a cross-sectional view taken along line B-B in FIG. 2.

As illustrated in FIGS. 2 and 3, the fin 10 is provided at an end in the reverse direction (the arrow R direction) of the main body portion 51 of the frame 5 in the direction of the rotation axis X. The fin 10 extends along the direction of the rotation axis X. An inner periphery at the end in the reverse direction of the main body portion 51 on the inner peripheral surface of the frame 5 is provided with a taper surface 53 that expands the diameter in the reverse direction. The fin 10 is provided in such a manner as to protrude inward in the radial direction from the taper surface 53 of the main body portion 51. Alternatively, the fin 10 is provided in such a manner as to protrude inward in the radial direction from a surface in an area lying across the taper surface 53 of the main body portion 51 and the inner peripheral surface of the main body portion 51 contiguous with the taper surface 53. In the example illustrated in the drawing, the taper surface 53 of the main body portion 51 is formed in the form of a curved surface protruding inward in the radial direction.

The fin 10 is formed in such a manner that a width thereof in the peripheral direction is, for example, 3° to 40° with respect to the inner peripheral surface of the frame 5. If the diameter of the reversible fan 1 is, for example, 160 mm, the fin 10 is formed in such a manner that the width is 3° to 7° with respect to the inner peripheral surface of the frame 5. If the diameter is 136 to 126 mm, the fin 10 is formed in such a manner that the width is 4° to 10°. If the diameter is 80 mm, the fin 10 is formed in such a manner that the width is 5° to 15°. If the diameter is 40 mm, the fin 10 is formed in such a manner that the width is 10° to 30°. Moreover, the fin 10 is formed in such a manner as to have a height at which the fin 10 does not come into contact with the blades 2*a* of the impeller 2 in the direction where the fin 10 protrudes inward in the radial direction. Furthermore, the fin 10 is formed in such a manner as to have a length in the direction of the rotation axis X within a range that does not hinder the path of the impeller 2.

The fin 10 includes a first curved surface 11 forming a surface in the normal rotation direction (the arrow n direction), a second curved surface 12 forming a surface in the reverse rotation direction (the arrow r direction), and an edge 13 connecting the first curved surface 11 and the second curved surface 12. The first curved surface 11 is formed as a curved surface protruding in the normal rotation direction. The second curved surface 12 is formed as a curved surface recessed in the normal rotation direction. In the example illustrated in the drawings, the fin 10 is formed in the form of a thin plate including the first curved surface 11 as the front side and the second curved surface 12 as the back side.

A separation space 14 where a part of a current of air in a predetermined direction flows is formed between the second curved surface 12 of the fin 10 and the inner peripheral surface of the frame 5 facing the second curved surface 12. In the example illustrated in the drawings, the separation space 14 is formed between the second curved surface 12 of the fin 10 and the taper surface 53 of the main body portion 51 of the frame 5.

Figure 4:
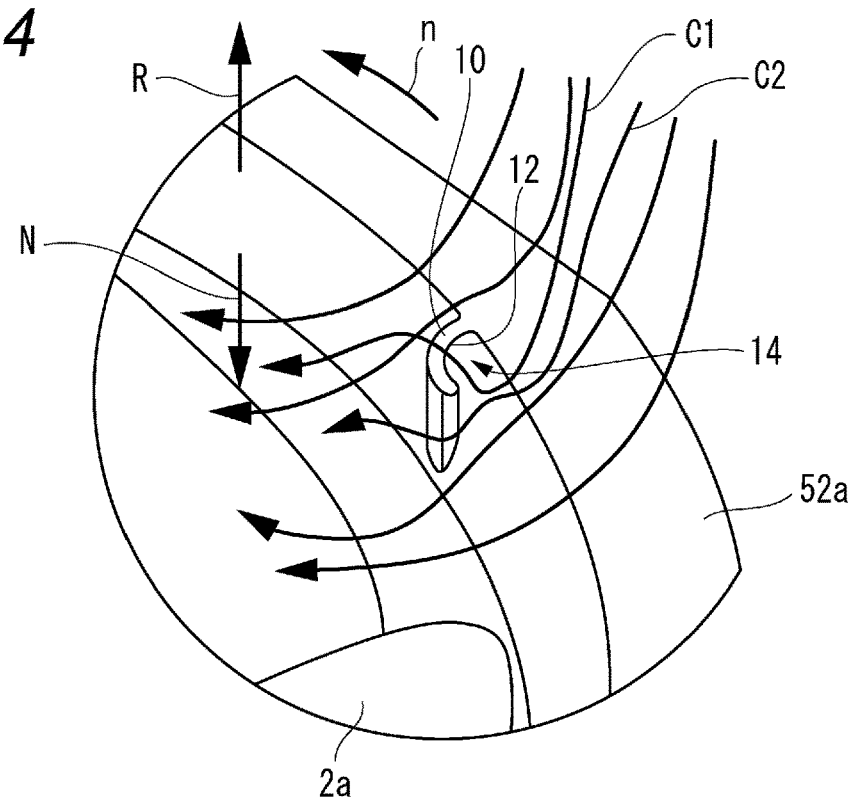
FIG. 4 is a diagram illustrating the flow of wind around the fin at times of producing a current of air in the normal direction.
Figure 5:
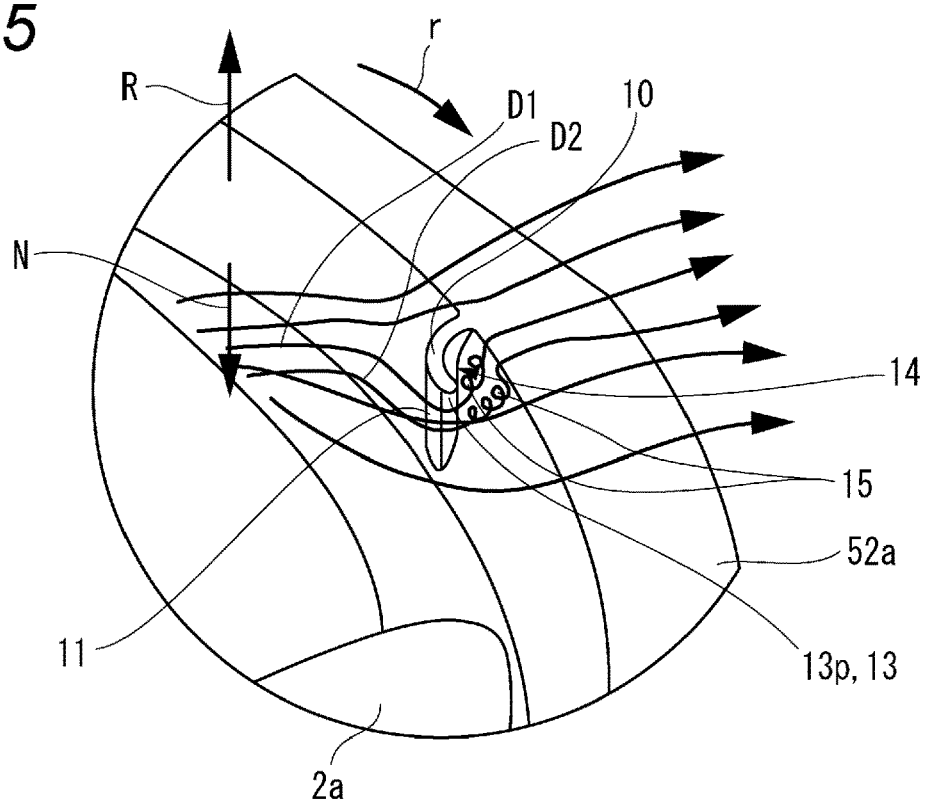
FIG. 5 is a diagram illustrating the flow of wind around the fin at times of producing a current of air in the reverse direction.

Next, the flow of wind in the reversible fan 1 is described with reference to FIGS. 4 and 5. FIG. 4 illustrates the flow of wind around the fin 10 at times of producing a current of air in the normal direction in the reversible fan 1. FIG. 5 illustrates the flow of wind around the fin 10 at times of producing a current of air in the reverse direction in the reversible fan 1.

For example, a part of a current of air that is produced in the reverse direction when the impeller 2 is rotated in the reverse rotation direction is separated by an end 13*p* in the reverse rotation direction at the edge 13 of the fin 10, and flows into the separation space 14. Moreover, for example, a part of a current of air that is produced in the normal direction when the impeller 2 is rotated in the normal rotation direction flows into the separation space 14.

The fin 10 includes an opening portion that is open to the normal rotation direction of the impeller and that is open to the airflow in the normal direction. In other words, the fin 10 is formed in a shape that bulges out opposed to the airflow in the reverse direction. On the other hand, the fin 10 is formed in a shape that has a recess for the airflow in the normal direction. In other words, the fin 10 is formed in such a manner that the airflow in the reverse direction has smaller fluid resistance than the airflow in the normal direction. The fin 10 is configured in such a manner that the airflow hitting the fin 10 produces noise. The fin 10 is formed in the shape that allows the airflow in the normal direction to produce louder noise than the airflow in the reverse direction.

As illustrated in FIG. 4, when in the reversible fan 1 the impeller 2 rotating in the normal rotation direction (the arrow n direction) produces a current of air in the normal direction (the arrow N direction), the current of air enters the frame 5 through an opening in the reverse direction of the frame 5. A part of the airflow then flows into the separation space 14 of the fin 10 provided at the end in the reverse direction of the main body portion 51. Hence, as indicated by, for example, arrows C1 and C2, the airflow flowing into the separation space 14 is blown and disturbed on the second curved surface 12 of the fin 10. Hence, the airflow is not smoothly taken into the frame 5. At this point in time, noise is produced since the airflow is obstructed by the fin 10.

On the other hand, as illustrated in FIG. 5, when in the reversible fan 1 the impeller 2 rotating in the reverse rotation direction (the arrow r direction) produces a current of air in the reverse direction (the arrow R direction), the current of air enters through an opening in the normal direction of the frame 5. At this point in time, a part of the airflow flowing out of the opening in the normal direction hits the first curved surface 11 of the fin 10 provided at the end in the reverse direction of the main body portion 51. The airflow that has hit the first curved surface 11 flows along the first curved surface 11. Hence, the airflow flows smoothly without producing loud noise. Furthermore, the airflow that has flowed along the first curved surface 11 is separated by the end 13*p* of the edge 13 of the fin 10 from the first curved surface 11 (an arc portion) of the fin 10 into the separation space 14. Consequently, as indicated by, for example, arrows D1 and D2, the separated airflow creates a vortex (turbulent flow) 15 to some extent in the separation space 14. Hence, the flow becomes regular and stable. Consequently, the noise produced by the airflow in the reverse direction is reduced.

Figure 6:
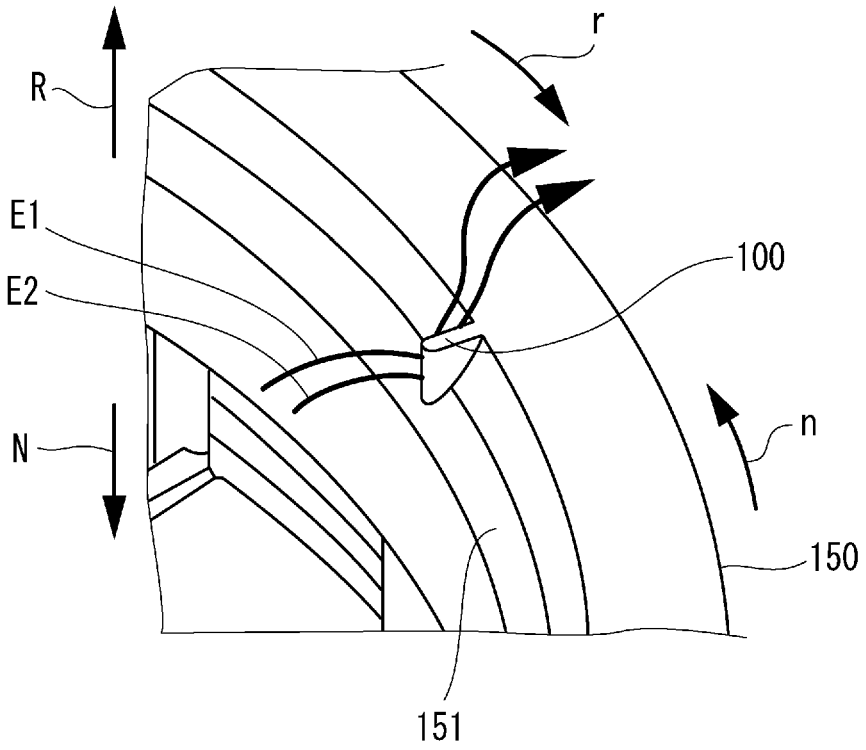
FIG. 6 is a perspective view illustrating a fin of a first comparative example.
Figure 7:
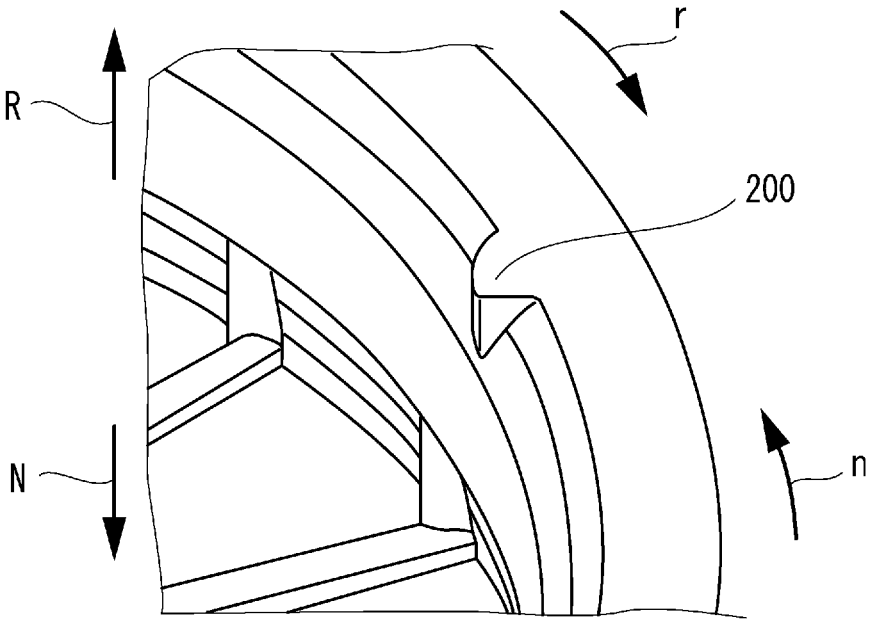
FIG. 7 is a perspective view illustrating a fin of a second comparative example.
Figure 8:
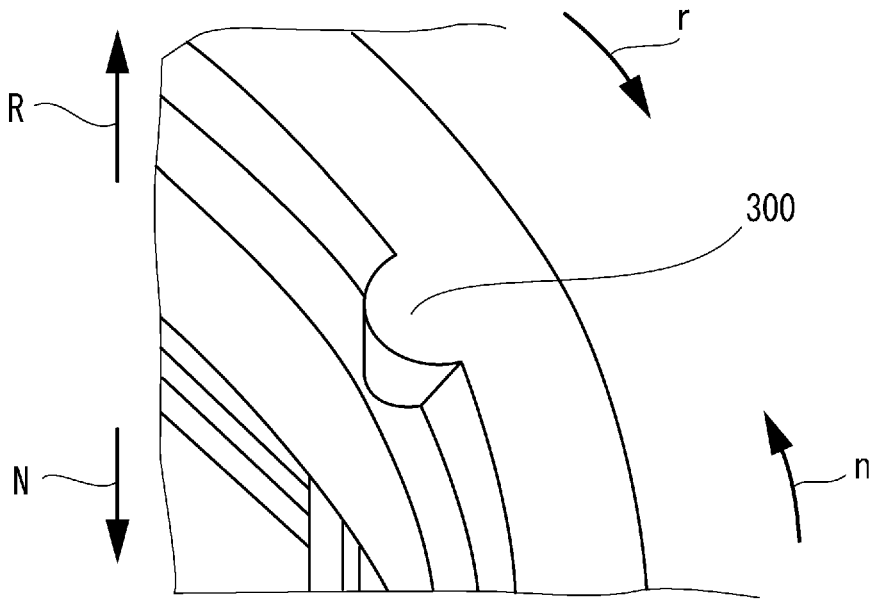
FIG. 8 is a perspective view illustrating a fin of a third comparative example.

In contrast to the embodiment, fins of a first to a third comparative example having shapes where the noise level at times of blowing air in the normal direction is not equal to the noise level at times of blowing air in the reverse direction are described, using FIGS. 6 to 8, to gain a deeper understanding of the fin 10 of the embodiment.

FIG. 6 is a perspective view illustrating a fin 100 of the first comparative example. The fin 100 is formed as a straight projection protruding vertically and inward in the radial direction from an inner peripheral surface 151 of a frame 150. However, a surface in the normal rotation direction (the arrow n direction) of the fin 100 configured in this manner is formed as a flat surface. Hence, when the impeller 2 rotating in the reverse rotation direction (the arrow r direction) produces a current of air in the reverse direction (the arrow R direction), the airflow is obstructed by the fin 100 as indicated by arrows E1 and E2. Hence, the noise level at times of blowing air in the reverse direction increases. As a result, it is not possible to prevent a difference between the noise levels from being made.

FIG. 7 is a perspective view illustrating a fin 200 of the second comparative example. A surface in the normal rotation direction (the arrow n direction) of the fin 200 is formed as a curved surface as in the fin 10 of the above embodiment. Moreover, a surface in the reverse rotation direction (the arrow r direction) of the fin 200 is formed as a flat surface as in the fin 100 of the first comparative example. In a case of the fin 200 configured in this manner, when the impeller 2 rotating in the reverse rotation direction produces a current of air in the reverse direction (the arrow R direction), the noise level decreases slightly since the surface in the normal rotation direction of the fin 200 is formed as the curved surface. However, the surface in the reverse rotation direction of the fin 200 is formed as the flat surface. Therefore, when the impeller 2 rotating in the normal rotation direction produces a current of air in the normal direction (the arrow N direction), the noise level hardly increases. As a result, it is not possible to reduce the difference between the noise level at times of blowing air in the normal direction and the noise level at times of blowing air in the reverse direction.

FIG. 8 is a perspective view illustrating a fin 300 of the third comparative example. A surface in the normal rotation direction (the arrow n direction) of the fin 300 is formed as a curved surface as in the fin 10 of the above embodiment. Moreover, a surface in the reverse rotation direction (the arrow r direction) of the fin 300 is formed as a curved surface protruding in the reverse rotation direction. However, in contrast to the fin 10 of the above embodiment, the separation space 14 is not provided. In a case of the fin 300 configured in this manner, when the impeller 2 rotating in the normal rotation direction produces a current of air in the normal direction (the arrow N direction), and also when the impeller 2 rotating in the reverse rotation direction produces a current of air in the reverse direction (the arrow R direction), airflow disturbance increases. As a result, the noise levels at times of blowing air in both directions increase.

In contrast, as illustrated in FIG. 2, the fin 10 is provided in the reversible fan 1 according to the embodiment in such a manner as to protrude inward in the radial direction from the inner peripheral surface of the frame 5. The fin 10 includes the first curved surface 11, the second curved surface 12, and the edge 13. The first curved surface 11 forms the surface in the normal rotation direction of the fin 10, and protrudes in the normal rotation direction. The second curved surface 12 forms the surface in the reverse rotation direction of the fin 10 and is recessed in the normal rotation direction. The edge 13 connects the first curved surface 11 and the second curved surface 12. The separation space 14 is formed between the second curved surface 12 and the inner peripheral surface of the frame 5. The separation space 14 separates a part of an airflow at the end 13*p* in the reverse rotation direction of the edge 13 when the impeller 2 rotates in the reverse rotation direction. Hence, the airflow in the normal rotation direction (normal direction) produced during positive rotation hits the second curved surface 12. The airflow that has hit the second curved surface 12 is disturbed by the second curved surface 12 and produces loud noise. On the other hand, the airflow that is produced during the reverse rotation of the impeller 2 and flows in the reverse rotation direction (reverse direction) hits the first curved surface 11. The airflow that has hit the first curved surface 11 flows along the first curved surface 11. Hence, the noise does not increase. Furthermore, a part of the airflow produced during the reverse rotation is separated by the separation space 14 and creates a vortex to some extent. Consequently, the airflow during the reverse rotation can be stabilized. Hence, the noise can be reduced. In this manner, it is possible to increase the noise at times of blowing air in the normal direction while reducing the noise at times of blowing air in the reverse direction. As a result, the noise level at times of blowing air in the normal direction can be made equal to the noise level at times of blowing air in the reverse direction.

Moreover, according to the reversible fan 1, the fin 10 has the recess for the airflow in the normal direction and bulges out opposed to the airflow in the reverse direction. In other words, the fin 10 is configured in such a manner that the airflow in the reverse direction has smaller fluid resistance than the airflow in the normal direction. Hence, the fin 10 produces louder noise due to the airflow in the normal direction than due to the airflow in the reverse direction. Therefore, the noise level at times of blowing air in the normal direction can be made equal to the noise level at times of blowing air in the reverse direction. At this point in time, the noise level at times of blowing air in the normal direction can be made equal to the noise level at times of blowing air in the reverse direction without exerting influence on the airflow characteristics, static pressure characteristics, and power consumption of the reversible fan 1.

Moreover, according to the reversible fan 1, the taper surface 53 that expands the diameter in the reverse direction is formed at the end of the frame 5 in the reverse direction in the direction of the rotation axis X. The fin 10 is provided on the taper surface 53 of the frame 5 in such a manner as to extend in the direction of the rotation axis X. Such a structure facilitates removal of the frame 5 from a die even if the fin 10 is provided.

(Modifications)

Next, modifications of the fin are described.

Figure 9:
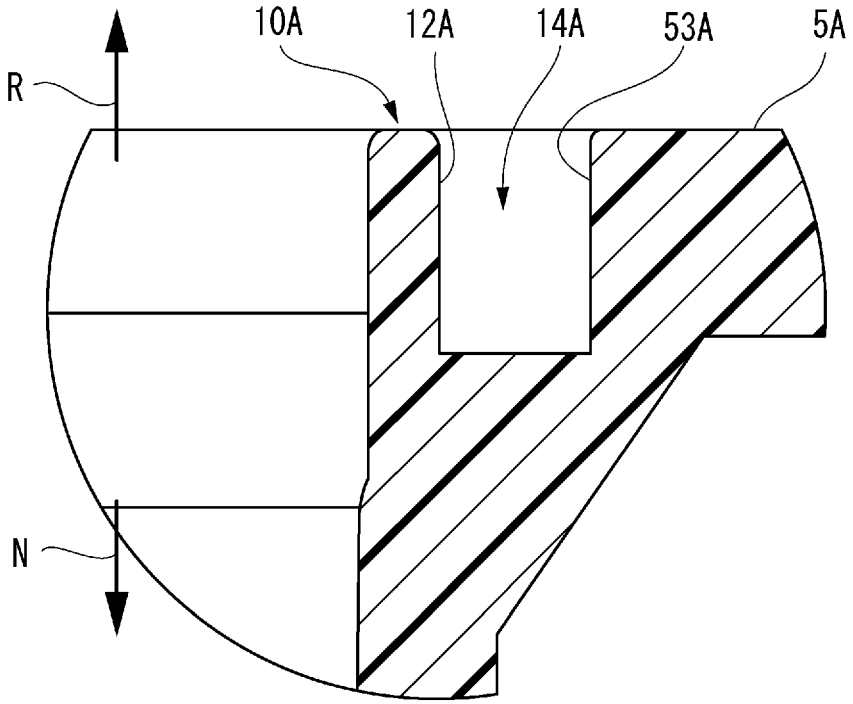
FIG. 9 is a cross-sectional view illustrating a fin of a first modification.

FIG. 9 is a cross-sectional view illustrating a fin 10A of a first modification. As illustrated in FIG. 9, the fin 10A is different from the fin 10 of the embodiment illustrated in FIG. 3 in the respect of being formed in such a manner that the shape of a separation space 14A in cross section becomes closer to a rectangle as compared with the fin 10. The fin 10A is formed in such a manner that a surface 53A on a frame 5A side forming the separation space 14A, that is, the surface 53A facing a second curved surface 12A of the fin 10A extends along the normal direction (the arrow N direction) of the rotation axis X.

Figure 10:
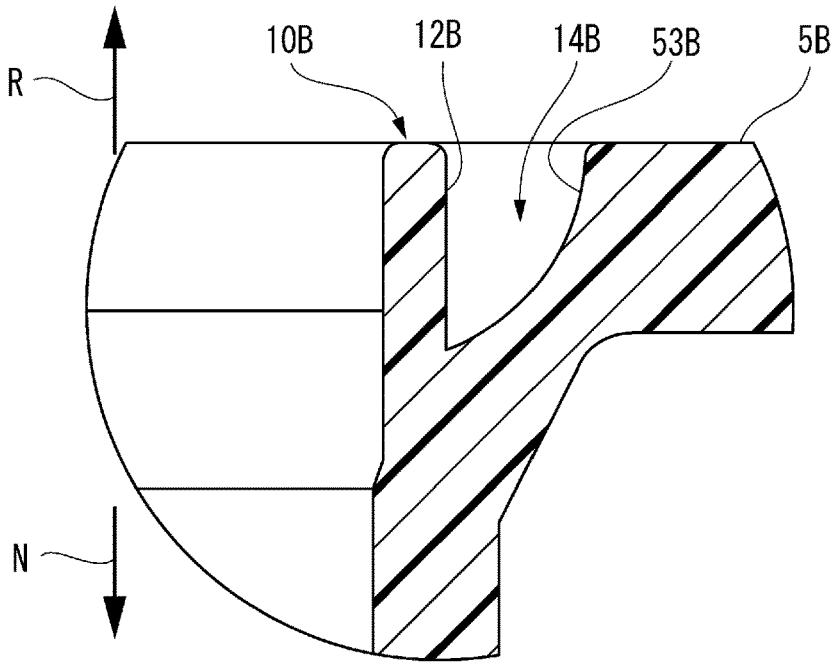
FIG. 10 is a cross-sectional view illustrating a fin of a second modification.

FIG. 10 is a cross-sectional view illustrating a fin 10B of a second modification. As illustrated in FIG. 10, the fin 10B is formed in such a manner that a surface 53B on a frame 5B side forming a separation space 14B, that is, the surface 53B facing a second curved surface 12B of the fin 10B is configured as a curved surface recessed outward in the radial direction. In this respect, the fin 10B is different from the fin 10 of the embodiment that includes the curved surface protruding inward in the radial direction. The shape of the curved surface recessed outward in the radial direction may be provided only to the surface 53B facing the second curved surface 12B. Alternatively, the recessed shape may be provided to the entire taper surface 53 of the main body portion 51 of the frame 5, the taper surface 53 being described in the embodiment.

Figure 11:
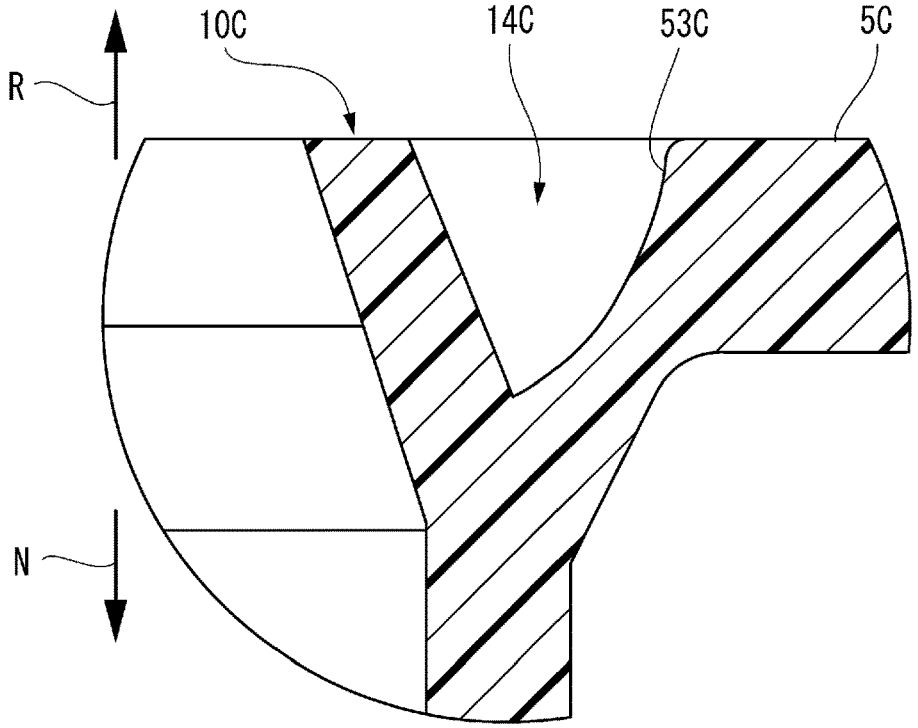
FIG. 11 is a cross-sectional view illustrating a fin of a third modification.

FIG. 11 is a cross-sectional view illustrating a fin 10C of a third modification. As illustrated in FIG. 11, the fin 10C is different from the fin 10B of the second modification illustrated in FIG. 10 in the respect that the direction in which the fin 10C extends is inclined with respect to the direction of the rotation axis X. The fin 10C is provided in such a manner as to be inclined inward in the radial direction (in a direction away from a surface 53C on a frame 5C side forming a separation space 14C) in going toward the reverse direction (the arrow R direction). In this respect, the fin 10C is different from the fin 10B of the second modification provided in such a manner as to extend in the direction of the rotation axis X.

Figure 12:
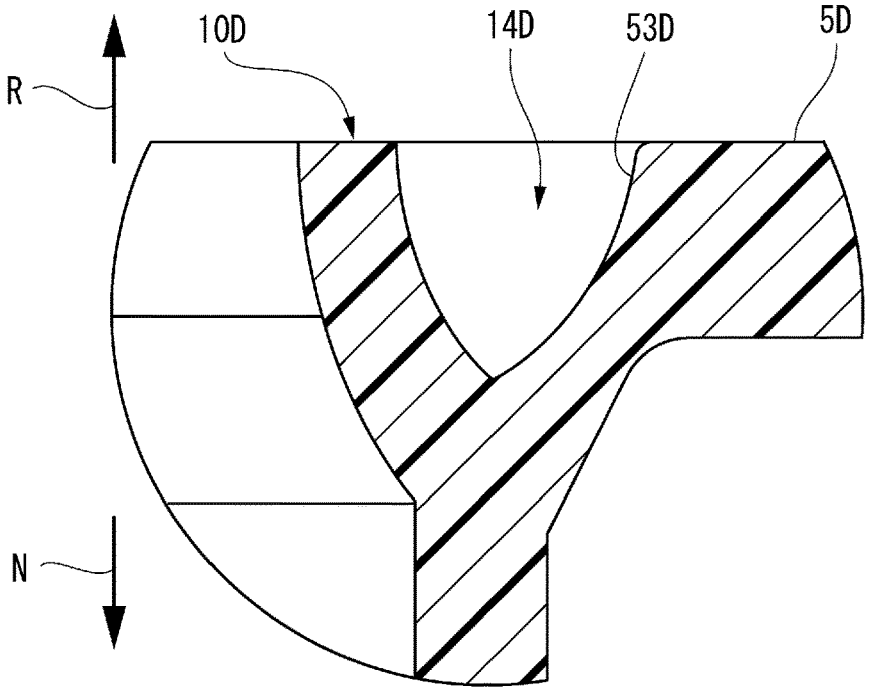
FIG. 12 is a cross-sectional view illustrating a fin of a fourth modification.

FIG. 12 is a cross-sectional view illustrating a fin 10D of a fourth modification. As illustrated in FIG. 12, the fin 10D is formed in such a manner as to be inclined inward in the radial direction (in a direction away from a surface 53D on a frame 5D side forming a separation space 14D) in going toward the reverse direction (the arrow R direction). In this respect, the fin 10D agrees with the fin 10C of the third modification illustrated in FIG. 11. However, the fin 10D is formed in such a manner as to include a curved surface protruding inward in the radial direction. In this respect, the fin 10C of the third modification without such a curved surface is different from the fin 10D.

Figure 13:
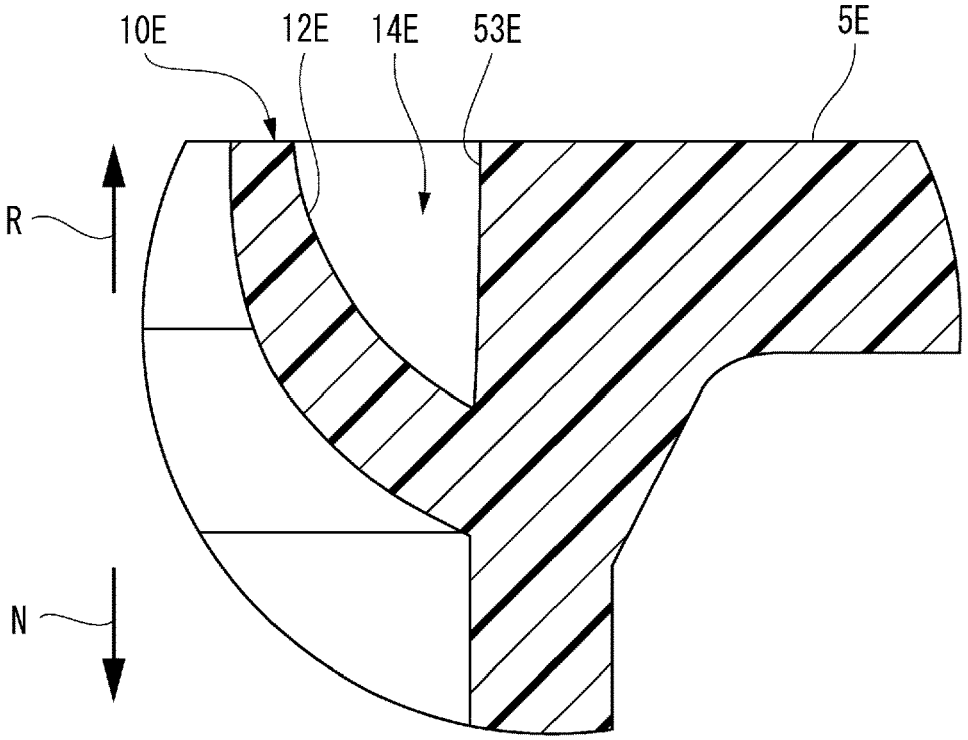
FIG. 13 is a cross-sectional view illustrating a fin of a fifth modification.

FIG. 13 is a cross-sectional view illustrating a fin 10E of a fifth modification. As illustrated in FIG. 13, as compared with the fin 10D of the fourth modification illustrated in FIG. 12, on the fin 10E, a surface 53E on a frame 5E side forming a separation space 14E, that is, the surface 53E facing a second curved surface 12E of the fin 10E is formed along the direction of the rotation axis X. In this respect, the fin 10E is different from the fin 10D of the fourth modification in FIG. 12 that is formed in such a manner as to include the curved surface recessed outward in the radial direction.

Figure 14:
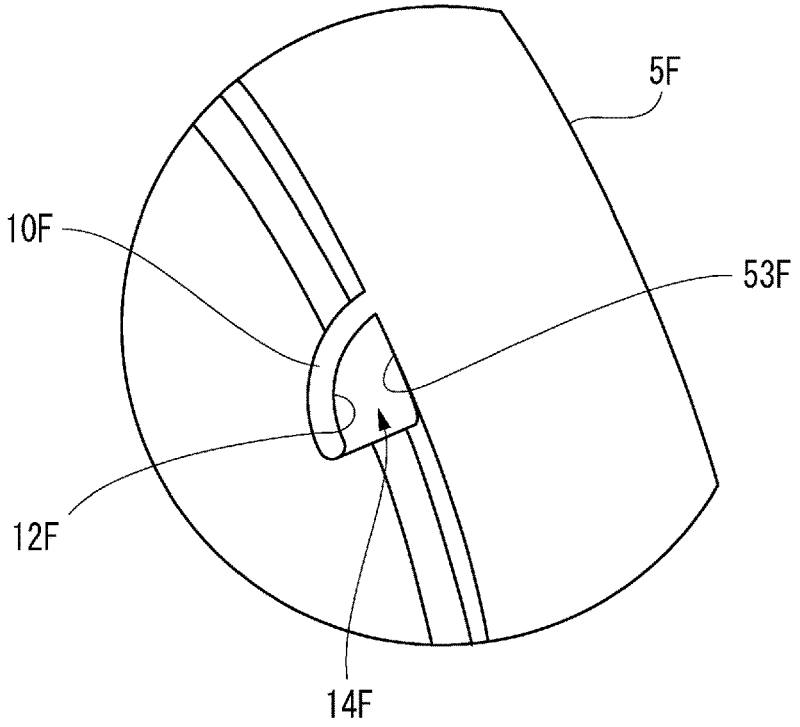
FIG. 14 is a diagram illustrating a fin of a sixth modification.

FIG. 14 is a diagram illustrating a fin 10F of a sixth modification. As illustrated in FIG. 14, on the fin 10F, a surface 53F on a frame 5F side forming a separation space 14F, that is, the surface 53F facing a second curved surface 12F of the fin 10F is formed along the direction of the rotation axis X. In this respect, the fin 10F is different from the fin 10 of the embodiment in FIG. 2 that is formed in such a manner as to include the curved surface protruding inward in the radial direction.

Figure 15:
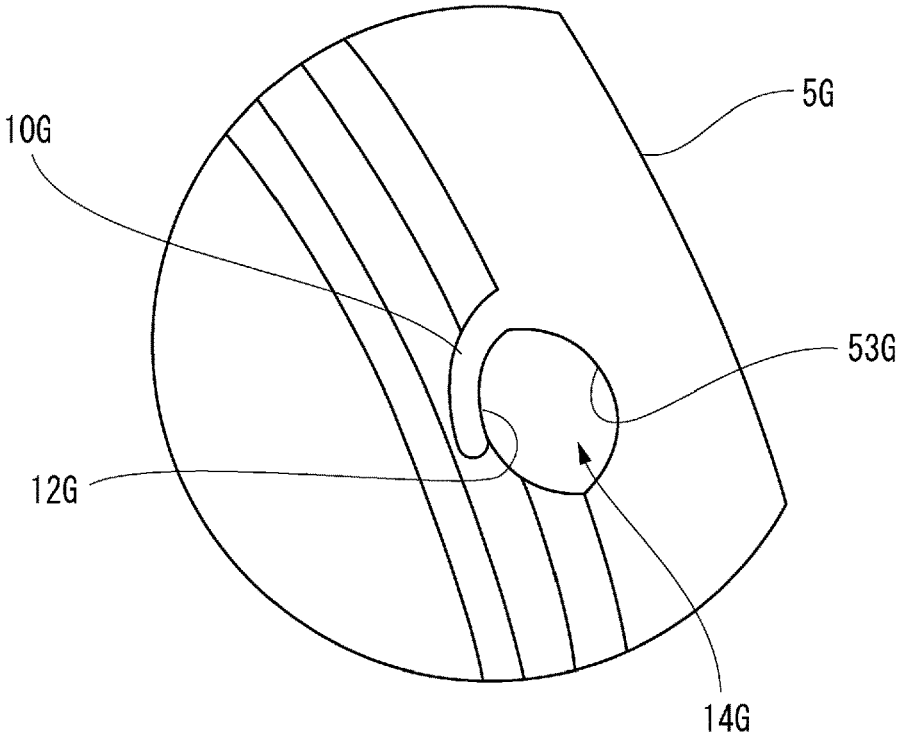
FIG. 15 is a diagram illustrating a fin of a seventh modification.

FIG. 15 is a diagram illustrating a fin 10G of a seventh modification. As illustrated in FIG. 15, on the fin 10G, a surface 53G on a frame 5G side forming a separation space 14G, that is, the surface 53G facing a second curved surface 12G of the fin 10G is formed by cutting out a peripheral wall of the frame 5G outward in the radial direction in the form of an arc. In this respect, the fin 10G is different from the fin 10 of the embodiment in FIG. 2 that is formed in such a manner as to include the curved surface protruding inward in the radial direction.

Figure 16:
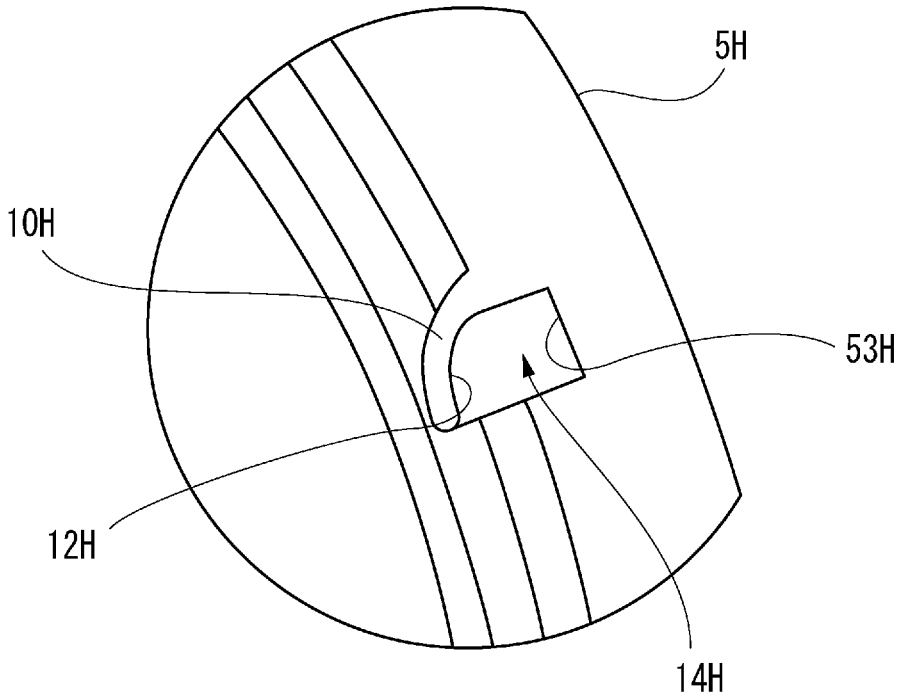
FIG. 16 is a diagram illustrating a fin of an eighth modification.

FIG. 16 is a diagram illustrating a fin 10H of an eighth modification. As illustrated in FIG. 16, as compared with the fin 10 of the embodiment illustrated in FIG. 2, on the fin 10H, a surface 53H on a frame 5H side forming a separation space 14H, that is, the surface 53H facing a second curved surface 12H of the fin 10H is formed by cutting out a peripheral wall of the frame 5H outward in the radial direction in the form of a rectangle. In this respect, the fin 10H is different from the fin 10 of the embodiment in FIG. 2 that is formed in such a manner as to include the curved surface protruding inward in the radial direction.

According to the fins 10A to 10H of the above modifications, the large separation spaces 14A to 14H can be secured. Hence, the noise level at times of blowing air in the normal direction can be increased. Consequently, the noise level at times of blowing air in the normal direction can be made equal to the noise level at times of blowing air in the reverse direction.

Up to this point the embodiment has been described. However, it is needless to say that the technical scope of the embodiment should not be construed in a limited manner by the description of the above-mentioned embodiment. The embodiment is a mere example. Those skilled in the art understand that the embodiment can be modified in various manners within the scope of the disclosure described in the claims. The technical scope of the present disclosure should be determined on the basis of the scope disclosed in the claims and the scope of equivalents thereof.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A reversible fan comprising:

a fin configured to produce a current of air in both of a normal direction and a reverse direction;

an impeller configured to be rotatable about a rotation axis;

a motor configured to rotate the impeller; and a tubular frame housing the impeller and the motor, the frame having an inner peripheral surface extending from an end in the normal direction to an end in the reverse direction, the inner peripheral surface including a third curved surface contiguous with the inner peripheral surface, the third curved surface being provided at an end of the frame in the reverse direction and a diameter of the third curved surface expanding in the reverse direction, wherein the fin has a shape that allows producing louder noise upon producing the current of air in the normal direction than upon producing the current of air in the reverse direction, and protrudes inward in a radial direction from the inner peripheral surface of the frame and the fin being attached to the inner peripheral surface along the third curved surface in a direction of the rotation axis.

2. The reversible fan according to claim 1, wherein the fin includes an opening portion that is open to a normal rotation direction of the impeller and is open to the current of air in the normal direction.

3. The reversible fan according to claim 1, wherein upon a direction of rotation of the impeller at times of producing the current of air in the normal direction being referred to as a normal rotation direction, and a direction of rotation of the impeller at times of producing the current of air in the reverse direction being referred to as a reverse rotation direction, the fin includes a first curved surface, a second curved surface, and an edge, the first curved surface is positioned in the normal rotation direction relative to the second curved surface, the first curved surface protrudes in the normal rotation direction, the second curved surface is recessed in the normal rotation direction, the edge connects the first and second curved surfaces, a separation space is formed between the second curved surface and the inner peripheral surface of the frame, and the separation space is configured in such a manner that, when the impeller rotates in the reverse rotation direction, a part of the current of air in the reverse direction is separated to flow in the separation space at the edge.

4. The reversible fan according to claim 3, wherein a part, which faces the second curved surface of the fin, of the inner peripheral surface of the frame is recessed outward in the radial direction.

* * * * *